US012687089B1

(12) United States Patent
Feddema et al.

(10) Patent No.: US 12,687,089 B1
(45) Date of Patent: Jul. 21, 2026

(54) DOWNHOLE TOOL SAFETY CATCH

(71) Applicant: TURBO DRILL INDUSTRIES, INC., Conroe, TX (US)

(72) Inventors: Chad Feddema, Conroe, TX (US); Sheldon Ritchie, Conroe, TX (US)

(73) Assignee: TURBO DRILL INDUSTRIES, INC., Conroe, TX (US)

( * ) Notice: Subject to any disclaimer, the term of this patent is extended or adjusted under 35 U.S.C. 154(b) by 0 days.

(21) Appl. No.: 19/387,987

(22) Filed: Nov. 13, 2025

(51) Int. Cl.
*E21B 40/00* (2006.01)

(52) U.S. Cl.
CPC ..... *E21B 40/001* (2020.05)

(58) Field of Classification Search
CPC ..... E21B 40/001
USPC ..... 166/382
See application file for complete search history.

(56) References Cited

U.S. PATENT DOCUMENTS

| | | | | |
|---|---|---|---|---|
| 6,540,020 | B1 | 4/2003 | Falgout, Sr. | |
| 7,063,175 | B1 | 6/2006 | Kerstetter | |
| 7,234,545 | B2 | 6/2007 | Pinol et al. | |
| 9,194,181 | B2 | 11/2015 | Connell et al. | |
| 9,540,877 | B2 | 1/2017 | Lanning et al. | |
| 9,695,638 | B2 | 7/2017 | Murray et al. | |
| 10,053,918 | B2 | 8/2018 | Sadabadi et al. | |
| 10,465,510 | B2 * | 11/2019 | Baudoin | E21B 49/003 |
| 10,753,152 | B1 | 8/2020 | Ritchie et al. | |
| 2016/0281429 | A1 | 9/2016 | Wilson et al. | |
| 2018/0305988 | A1 | 10/2018 | Gharib et al. | |
| 2020/0018120 | A1 | 1/2020 | Riddel et al. | |
| 2020/0131874 | A1 * | 4/2020 | Cajiles | E21B 33/12 |
| 2020/0325750 | A1 * | 10/2020 | Zachry | E21B 33/1293 |
| 2021/0172251 | A1 * | 6/2021 | Leung | E21B 4/02 |
| 2023/0399911 | A1 * | 12/2023 | Trinh | E21B 21/10 |
| 2025/0257611 | A1 * | 8/2025 | Kerstetter | E21B 7/068 |

* cited by examiner

*Primary Examiner* — Tara Schimpf
*Assistant Examiner* — Patrick F Lambe
(74) *Attorney, Agent, or Firm* — Ewing & Jones, PLLC

(57) ABSTRACT

A downhole catch assembly includes a catch stem having a radial protrusion to provide a landing shoulder and a catcher sub having a longitudinal central axis and the radial protrusion of the catch stem located within the catcher sub. A landing ledge extends radially inward inside the catcher sub for engagement with the landing shoulder of the catch stem. An installation bore angled relative to the longitudinal central axis enters a bottom terminus of the catcher sub offset relative to radial center of the catcher sub. The installation bore extends into the catcher sub above the landing ledge to facilitate installing the catch stem into the catcher sub.

20 Claims, 5 Drawing Sheets

DOWNHOLE TOOL SAFETY CATCH

TECHNICAL FIELD/FIELD OF THE DISCLOSURE

The present disclosure relates generally to downhole tools and specifically catches such as mandrel catches for stroking tools or rotor catches for downhole motors.

BACKGROUND OF THE DISCLOSURE

Many downhole tools include components, such as stroking tools or motors, coupled by threaded connections that may come apart or fail with undesired potential for lower portions of the tools unable to be retrieved to surface. A catch installed above the tool may retain an inner component to the rest of the drill string when the drill string is removed from the wellbore in such an eventuality. The catch typically includes a catch stem within a catch housing configured such that the entire string is pulled out of the wellbore despite the failure. However, narrow openings at a top of the prior catch housings due to double shouldered connections may limit ability to insert the catch stem or install a retaining cap on the catch stem.

SUMMARY

For some embodiments, a downhole catch assembly includes a catch stem having a radial protrusion to provide a landing shoulder and a catcher sub having a longitudinal central axis and the radial protrusion of the catch stem located within the catcher sub. A landing ledge extends radially inward inside the catcher sub for engagement with the landing shoulder of the catch stem in a landed position. Upper and lower axial bore faces align with the longitudinal central axis and are formed inside of the catcher sub above the landing ledge to facilitate in keeping the catch stem engaged with the landing ledge in the landed position. An installation bore angled relative to the longitudinal central axis enters a bottom terminus of the catcher sub offset relative to radial center of the catcher sub. The installation bore extends into the catcher sub to intersect between the upper and lower axial bore faces to facilitate installing the catch stem into the catcher sub.

According to some embodiments, a method of using a downhole catch assembly includes providing a catcher sub having a longitudinal central axis and a landing ledge extending radially inward inside the catcher sub and providing a catch stem having a radial protrusion forming a landing shoulder for engagement with the landing ledge within the catcher sub. The method further includes aligning the catch stem with an installation bore angled relative to the longitudinal central axis and entering a bottom terminus of the catcher sub offset relative to radial center of the catcher sub. In addition, the method includes inserting the radial protrusion of the catch stem through the installation bore of the catcher sub while the catch stem is aligned with the installation bore of the catcher sub. Aligning the catcher sub with a tubular outer housing surrounding the catch stem once the radial protrusion of the catch stem is inserted above the landing ledge enables coupling the catcher sub and the tubular outer housing together while aligned with each other.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
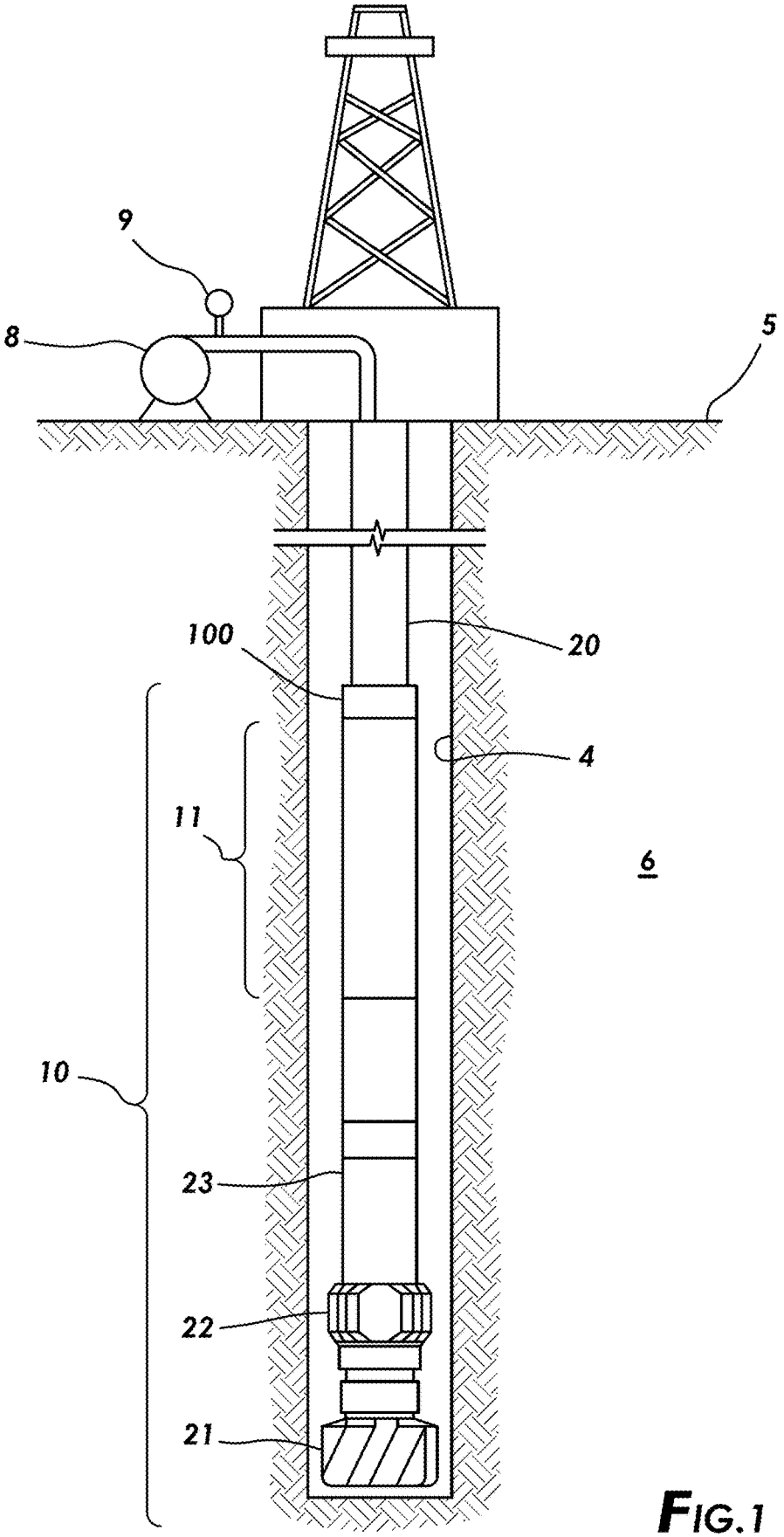
FIG. 1 is a schematic view of a drill string positioned in a wellbore, the drill string including a catcher sub consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts wellbore 4 during a drilling operation of wellbore 4. Wellbore 4 may extend from surface 5 into earthen formation 6 and may be formed using drill string 20. One or more pumps 8 may be positioned at surface 5 to provide fluid flow through drill string 20. In some embodiments, gauge 9 may be positioned at surface 5 to measure the pressure and/or flow rate within drill string 20.

In some embodiments, drill string 20 may include bottomhole assembly (BHA) 10 positioned within wellbore 4. A catcher sub 100 coupled to a downhole tool 11 may form part of the BHA 10 or be located along the drill string 20 above the BHA 10. Examples of the downhole tool 11 include a friction reduction tool such as a stroker tool (see, catcher sub 100 as configured in FIG. 2) or power section (see, catcher sub 100 as configured in FIG. 7).

The downhole tool 11 that is a power section may include a turbine motor or a positive displacement motor (PDM), such as a progressive cavity mud motor. In some embodiments, BHA 10 may include one or more rotating components including, for example and without limitation, drill bit 21 as well as additional components such as rotary steerable system 22. In some embodiments, BHA 10 may include one or more components configured to axially support the rotating components of BHA 10 when drill bit 21 is raised off the bottom of wellbore 4 including, for example and without limitation, bearing section 23.

Figure 2:
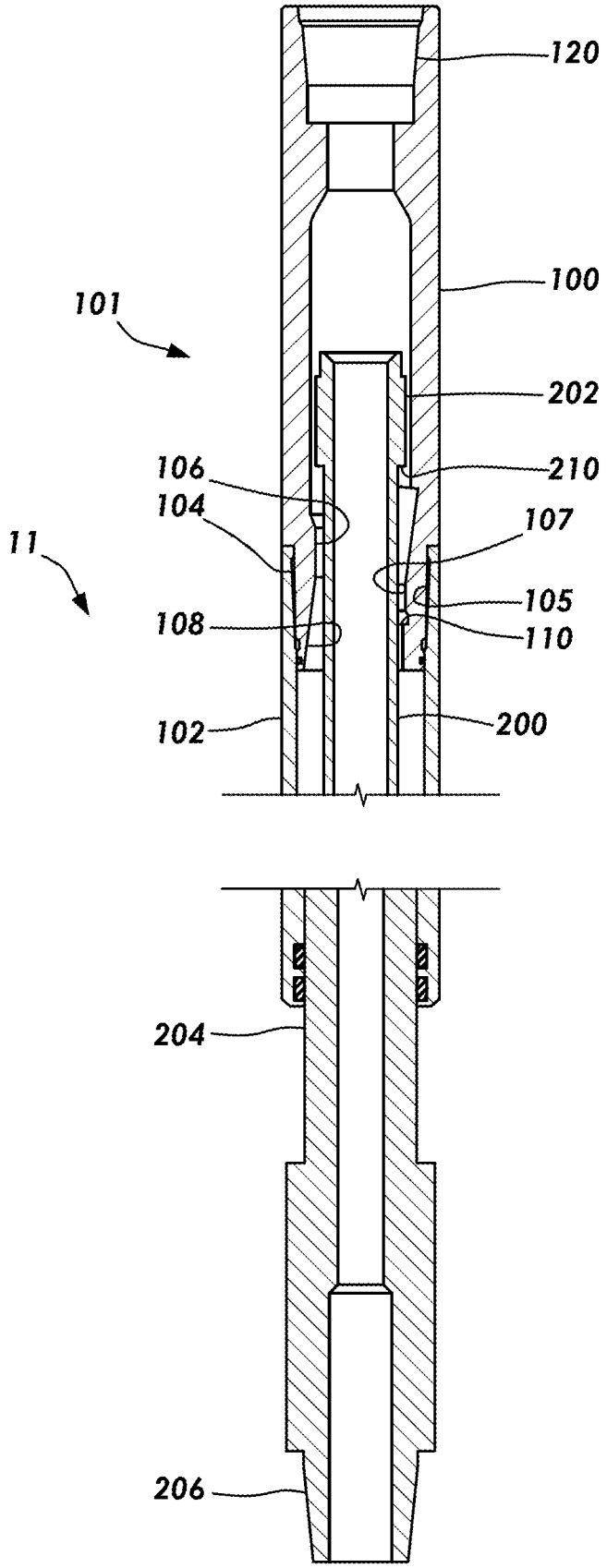
FIG. 2 is a cross-sectional view of a catch stem disposed within the catcher sub in a normal operating position of a downhole catch assembly.

FIG. 2 illustrates a catch stem 200 disposed within the tubular shape, which may include axially aligned through bore, of the catcher sub 100 in a normal operating position of a downhole catch assembly 101 shown as a stroker tool catch. The catcher sub 100 couples to the drill string 20 shown in FIG. 1 at a connection 120. Since the downhole tool 11 depicted in FIG. 2 is the stroker tool, a mandrel assembly 204 with the catch stem 200 may stroke relative to a tubular outer housing 102. The mandrel assembly 204 thus may axially extend out and retract into the tubular outer housing 102 with the tubular shape of the catcher sub 100 internally open above retention features described herein for accommodating corresponding sliding axial movement of the catch stem 200 relative to the catcher sub 100. Further, the mandrel assembly 204 may rotate relative to the tubular outer housing 102, such as through use of splined engagement between the mandrel assembly 204 and the tubular outer housing 102 to impart torsional movement.

For some embodiments, additional drill pipe, the drill bit 21 or a bit coupler attaches to a bottom connector 206 at a bottom terminus of the mandrel assembly 204. The catch stem 200 may provide a top terminus of the mandrel assembly 204. The catch stem 200 may be integral with or attached to the mandrel assembly 204 within the downhole tool 11. If any threaded connections come apart or other separation failure occurs along the tubular outer housing 102 below the downhole catch assembly 101, the mandrel assembly 204 by engagement with both the tubular outer housing 102 and within the catcher sub 100 as described herein enables parts below the catcher sub 100 to be retrieved as the catcher sub 100 is pulled back to surface 5. The mandrel assembly 204 may engage with the tubular outer housing 102 via the bearing section 23, the downhole tool 11, any other coupling to connect the mandrel assembly 204 and the tubular outer housing 102, and/or an interference between an inner diameter of the tubular outer housing 102 and an outer diameter of the mandrel assembly 204, such as visible by the mandrel assembly 204 being enlarged below the tubular outer housing 102 in FIG. 2.

In the normal operating position of the downhole catch assembly 101, a connector end or pin 104 of the catcher sub 100 forms a connection that may be threaded with a mating end or box 105 of the tubular outer housing 102. The catch stem 200 includes a radial protrusion 202 that may be an upset or outward radial extension of catch stem 200 proximate a top of the catch stem 200. The radial protrusion 202 may be annular, may extend around the entire periphery of the catch stem 200 and may have a cylindrical profile.

Figure 3:
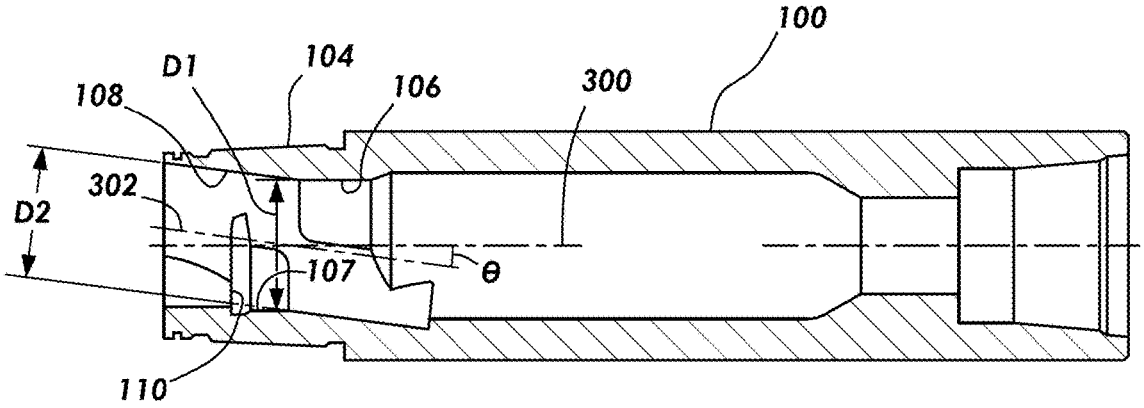
FIG. 3 is a cross-sectional view of the catcher sub having an installation bore that is angled and offset from an axial bore.

As shown in FIG. 3, the catcher sub 100 at the pin 104 includes an installation bore 108 that is angled and offset from an axial bore defined by upper and lower axial bore faces 106, 107. The upper and lower axial bore faces 106, 107 align parallel with a longitudinal central axis 300 of the catcher sub 100. The upper and lower axial bore faces 106, 107 may further be centered radially within the catcher sub 100 with a first diameter D1 inside of the catcher sub 100. The first diameter D1 and length of the catcher sub 100 having the upper and lower axial bore faces 106, 107 corresponds with size of the radial protrusion 202 to establish a tight concentric clearance fit between the upper and lower axial bore faces 106, 107 and the radial protrusion 202 when together.

The installation bore 108 extends into the catcher sub 100 through an open bottom terminus of the pin 104 and has axis centerline 302 at an angle θ, such as at least 4° or between 4° and 15°, relative to the longitudinal central axis 300. For example, the angle θ may be less than the wellbore 4 bends/tilts for proper operation of the downhole catch assembly 101 to ensure that the catch stem 200 is retained by the catcher sub 100 in use. The installation bore 108 enters the bottom terminus of the catcher sub 100 at the pin 104 with the axis centerline 302 offset relative to the radial center of the pin 104.

Due to the offset and the angle θ, the installation bore 108 intersects with the axial bore defined by the upper and lower axial bore faces 106, 107 such that the longitudinal central axis 300 and the axis centerline 302 intersection is between the upper and lower axial bore faces 106, 107. A second diameter D2 of the installation bore 108 inside of the catcher sub 100 may be at least as large as outside diameter of the radial protrusion 202 of the catch stem 200 and may match or be at least as large as the first diameter D1 that is defined by the upper and lower axial bore faces 106, 107. Given size and placement of the installation bore 108, the upper axial bore face 106 forms a first partial cylindrical inner surface of the catcher sub 100 that is opposite to a second partial cylindrical inner surface of the catcher sub 100 formed by the lower axial bore face 107. Since partial and thus may be noncircular after forming the installation bore 108, the first diameter D1 corresponds to diameter of the axial bore creating the upper and lower axial bore faces 106, 107 and is the diameter of the partial cylindrical inner surfaces if fully cylindrical.

The installation bore 108 creates the first and second partial cylindrical inner surfaces that are hence circumferentially incomplete around the inside of the catcher sub 100. The installation bore 108 cuts into the inner surface of the catcher sub 100 on a first side upward from the pin 104 corresponding in length up to where the lower axial bore face 107 ends. The installation bore 108 then cuts into the inner surface of the catcher sub 100 on an opposite second side continuing upward beyond the upper axial bore face 106.

A landing ledge 110 inside the catcher sub 100 extends radially inward below the lower axial bore face 107 and is sized such that a landing shoulder 210 formed by a bottom edge of the radial protrusion 202 on the catch stem 200 seats against and is retained by the landing shoulder 210 in use (see, FIG. 6 with the downhole catch assembly 101 in the landed position). The installation bore 108 may cut into the inner surface of the catcher sub 100 on the first side at the landing ledge 110 making the landing ledge 110 also circumferentially incomplete around the inside of the catcher sub 100. The landing ledge 110 location, which is exemplarily shown within the pin 104, may vary as illustrated in other embodiments provided the location is between the bottom terminus of the catcher sub 100 and the lower axial bore face 107. In manufacturing of the catcher sub 100, the landing ledge 110 may be formed by a portion of the catcher sub 100 being machined with a smaller diameter axial bore than both the outside diameter of the radial protrusion 202 of the catch stem 200 and the first diameter D1 provided by the upper and lower axial bore faces 106, 107.

Figure 4:
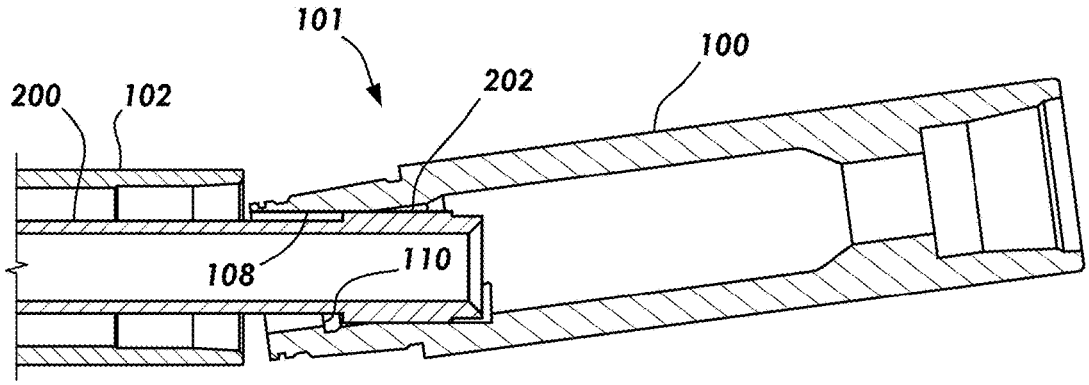
FIG. 4 is a cross-sectional view of the catcher sub with the catch stem partially inserted into the angled bore while putting the downhole catch assembly together.

FIG. 4 depicts a makeup step of the downhole catch assembly 101. In some embodiments, the bore through the inside of the catcher sub 100 may have an internal dimension, such as due to a double shouldered connection, that prevents access or insertion of the radial protrusion 202 through the top end of the catcher sub 100 during makeup of the downhole catch assembly 101. In the makeup step, the catch stem 200 partially inserts into the catcher sub 100 via the installation bore 108. The catch stem 200 and the catcher sub 100 align angled to one another at about the angle θ while the catch stem 200 is inserted until the radial protrusion 202 is located above the landing ledge 110. The catch stem 200 may pass along installation bore 108 during the makeup step until reaching an upper end of the installation bore 108 and/or the radial protrusion 202 is longitudinally disposed within the upper and lower axial bore faces 106, 107.

Figure 5:
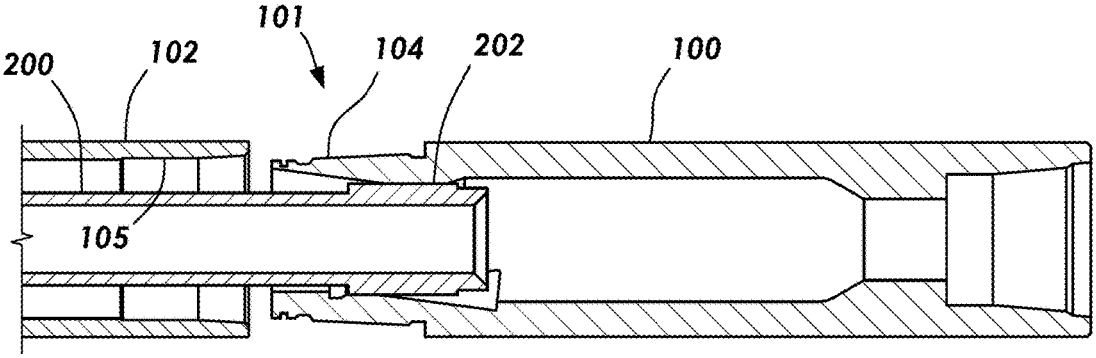
FIG. 5 is a cross-sectional view of the catcher sub and the catch stem inserted and aligned in a subsequent step of putting the downhole catch assembly together prior to connecting the catcher sub with an outer housing.

FIG. 5 illustrates a connection step following the makeup step shown in FIG. 4. In the connection step, the catcher sub 100 pivots to align with the catch stem 200 and the tubular outer housing 102. The pivoting enabled by the installation bore 108 intersecting between the upper and lower axial bore faces 106, 107 allows the pin 104 to be threaded to the box 105 connecting the catcher sub 100 to the tubular outer housing 102. Clearance between the radial protrusion 202 and the upper and lower axial bore faces 106, 107 also enables the catch stem 200 to pass longitudinally upward within the catcher sub 100 during makeup of the pin and box 104, 105 together. After the connection step, the downhole catch assembly 101 becomes ready for deployment into the wellbore 4 and is thus in the normal operating position as shown in FIG. 2.

Figure 6:
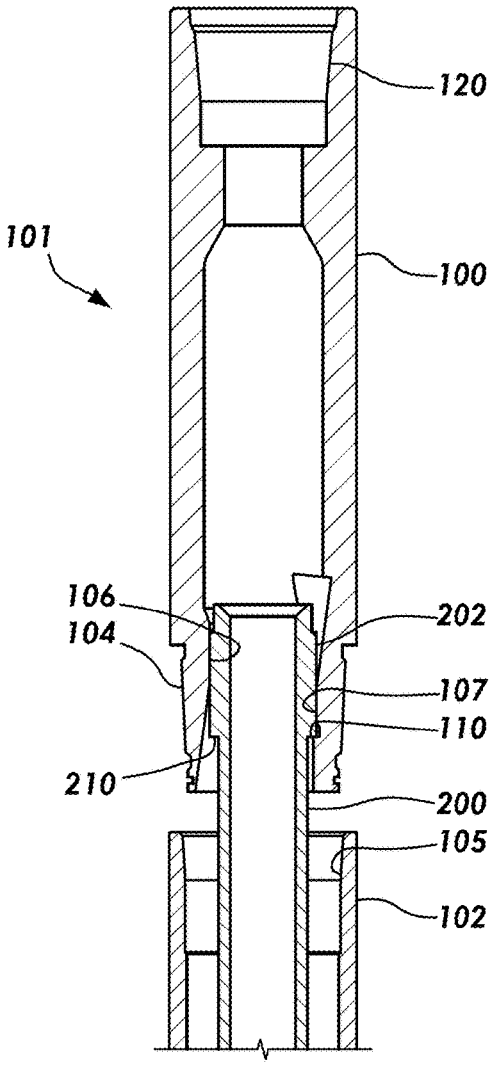
FIG. 6 is a cross-sectional view of the downhole catch assembly in a landed position having the catch stem engaged with a landing ledge within the catcher sub.

FIG. 6 shows the downhole catch assembly 101 in a landed position having the catch stem 200 engaged with the landing ledge 110 within the catcher sub 100. In the wellbore 4 with the catcher sub 100 still torqued into the drill string 20 at the connection 120, the catcher sub 100 and the catch stem 200 lack ability to pivot relative to one another as manipulated out of the wellbore 4 during the makeup step. For example, the downhole catch assembly 101 may be constrained from the pivoting by surrounding interference of the wellbore 4. Thus, the landing shoulder 210 of the catch stem 200 abuts the landing ledge 110 without bypassing the landing ledge 110 as done during the makeup step. Further, the tight concentric clearance fit between the upper and lower axial bore faces 106, 107 and the radial protrusion 202 facilitates in keeping the catch stem 200 engaged with the landing ledge 110.

The landed position of the downhole catch assembly 101 may occur in operation when there is separation below the catcher sub 100, such as shown by the pin 104 separated from the box 105. Pulling the catcher sub 100 with the drill string 20 thereby also pulls the tubular outer housing 102 and remainder of BHA 10 for retrieval back to surface 5. Specifically, the catch stem 200 provides a physical connection holding catcher sub 100 and the tubular outer housing 102 together.

Figure 7:
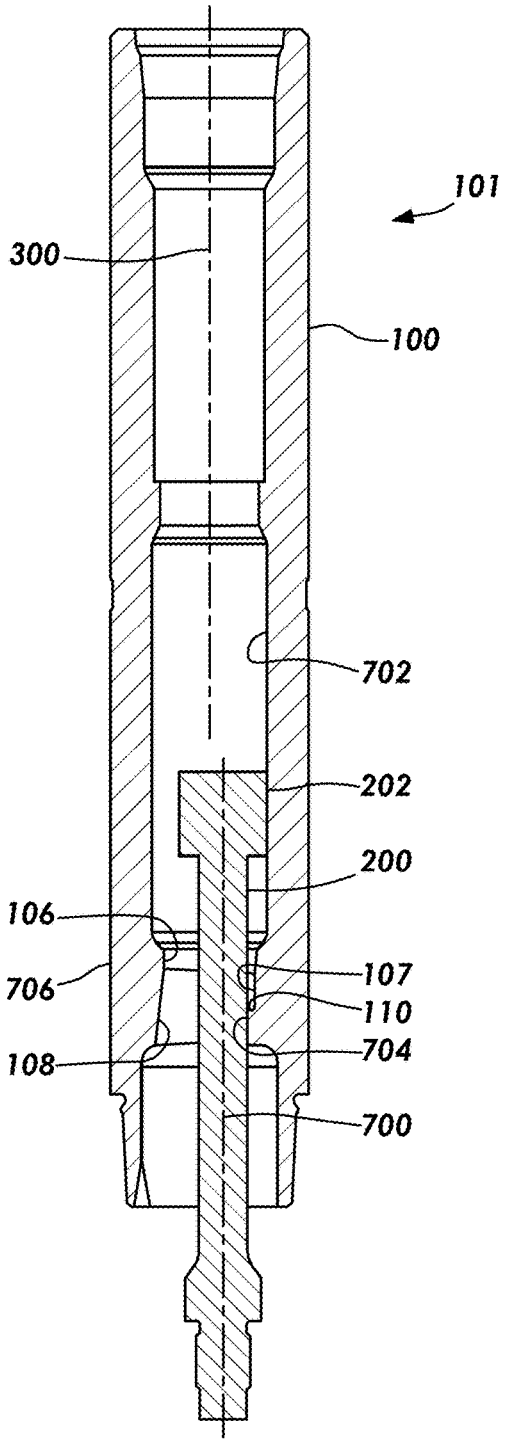
FIG. 7 is a cross-sectional view of the catch stem fitted in the catcher sub to permit eccentric motion during normal operation as a mud motor rotor catch consistent with at least one embodiment of the present disclosure.

FIG. 7 depicts the catch stem 200 fitted in the catcher sub 100 to permit eccentric motion (depicted by rotor centerline 700 shown offset from the longitudinal central axis 300 of the catcher sub 100) during normal operation of the downhole catch assembly 101 as a mud motor rotor catch. For the rotor catch option, the catch stem 200 couples to rotate with a rotor of the power section that also includes a stator (which may be part of the tubular outer housing 102 such as shown in FIGS. 4-6) with a bore for surrounding and operatively engaging with the rotor to impart relative rotation. An enlarged internal bore 702 of the catcher sub 100 above the upper axial bore face 106 and with inside diameter greater than the first diameter D1 (shown and described in FIG. 3) accommodates the radial protrusion 202 of the catch stem 200 throughout the eccentric motion. In addition, the landing ledge 110 created by restricted bore face 704 extends radially inward enough to seat the radial protrusion 202 of the catch stem 200 while also permitting the eccentric motion of a part of the catch stem 200 extending along the restricted bore face 704 during rotational operation of the catch stem 200.

For some embodiments, the catcher sub 100 may include an external orienting marker 706 to facilitate assembly/disassembly and serviceability of the downhole catch assembly 101. The external orienting marker 706 may identify orientation, such as a top side, of the installation bore 108 relative to a circumference of the catcher sub 100. In some embodiments, the external orienting marker 706 includes a groove visible on the catcher sub 100 after makeup of the downhole catch assembly 101.

Figure 8:
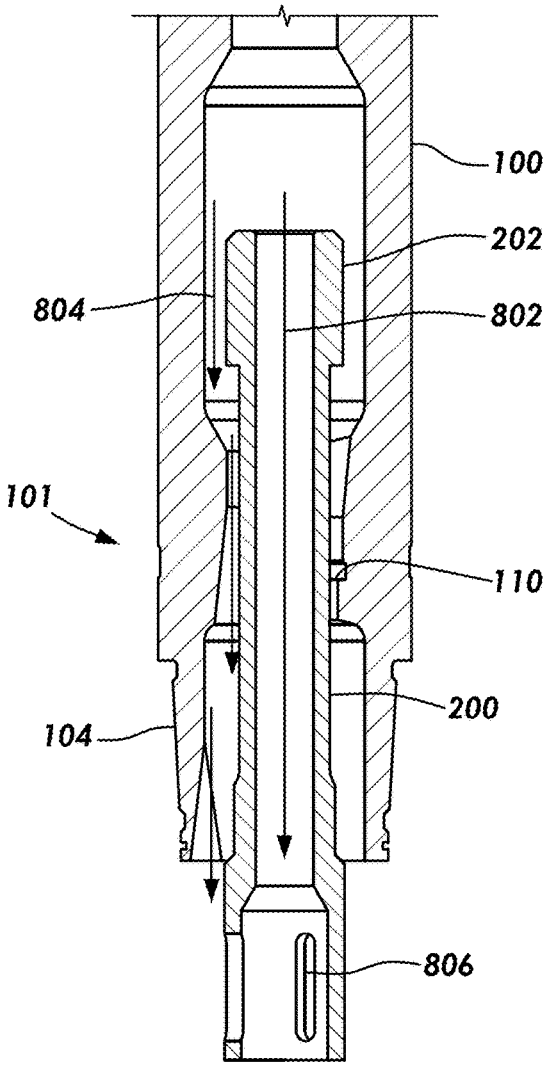
FIG. 8 is a cross-sectional view of the downhole catch assembly in the normal operating position showing an alternative location of the landing ledge and multiple flow paths through the downhole catch assembly.

FIG. 8 illustrates the downhole catch assembly 101 in the normal operating position showing an alternative location of the landing ledge 110 and central and annular flow paths 802, 804 through the downhole catch assembly 101. The central flow path 802 extends along an inner bore throughout an entire length of the catch stem 200. The annular flow path 804 in the normal operating position remains open between the outside of the catch stem 200 and inside of the catcher sub 100 along length of the catch stem 200 including where passing through the landing ledge 110. An aperture 806 through a wall of the catch stem 200 at a lower section of the catch stem 200 spaced opposite of the radial protrusion 202 may allow the annular flow path 804 to be in fluid communication with the central flow path 802 and hence merge back with the central flow path 802.

Figure 9:
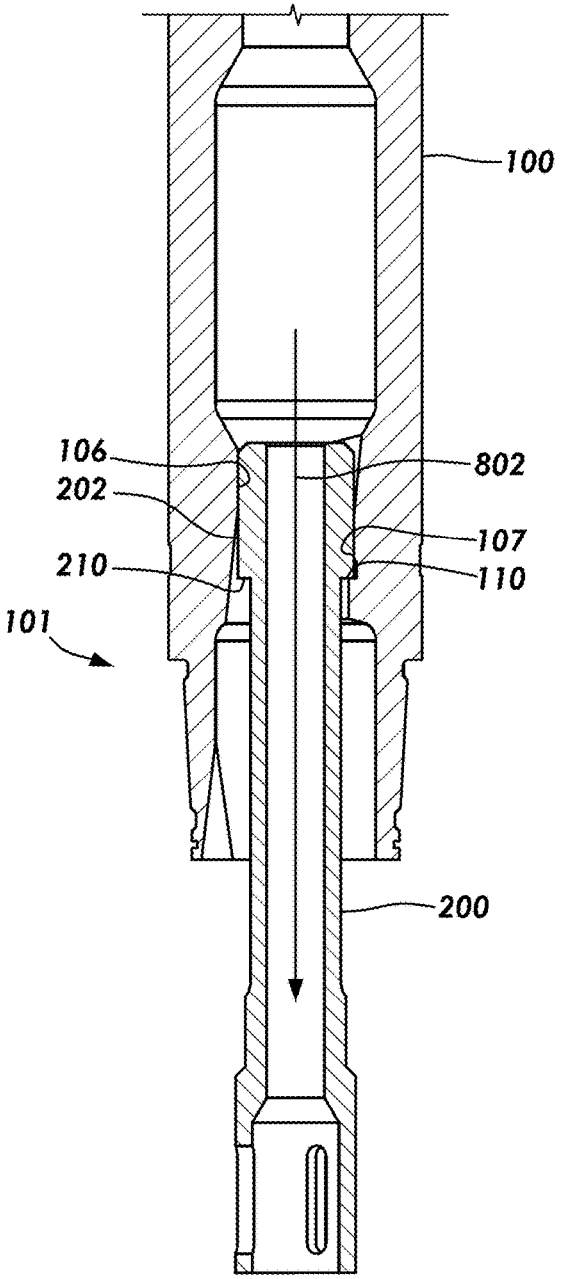
FIG. 9 is a cross-sectional view of the downhole catch assembly shown in FIG. 8 in the landed position and providing a pressure increase indicator due to annular flow path closing.

FIG. 9 shows the downhole catch assembly 101 in the landed position and providing a pressure increase indicator due to the annular flow path 804 that is shown in FIG. 8 closing leaving only the central flow path 802 open for fluid communication to below the landing ledge 110. The tight concentric clearance fit between the upper and lower axial bore faces 106, 107 and the radial protrusion 202 in the landed position effectively blocks flow except for through the central flow path 802. Sensing a pressure increase that results from the closure provides the pressure indicator to an operator and is indicative of the downhole catch assembly 101 being in the landed position, which informs the operator that there has been a separation/failure below the catcher sub 100.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A downhole catch assembly, comprising:

a catch stem having a radial protrusion to provide a landing shoulder; and a catcher sub having a longitudinal central axis and the radial protrusion of the catch stem located within the catcher sub, wherein:

a landing ledge extends radially inward inside the catcher sub for engagement with the landing shoulder of the catch stem in a landed position;

upper and lower axial bore faces align with the longitudinal central axis and are formed inside of the catcher sub above the landing ledge;

an installation bore angled relative to the longitudinal central axis enters a bottom terminus of the catcher sub offset relative to radial center of the catcher sub; and the installation bore extends into the catcher sub to intersect between the upper and lower axial bore faces, wherein the radial protrusion of the catch stem is nested in both the upper and lower axial bore faces in the landed position and the radial protrusion of the catch stem is insertable through the installation bore into the bottom terminus of the catcher sub without engagement with the landing ledge when installing the catch stem into the catcher sub.

2. The downhole catch assembly of claim 1, wherein the catch stem is coupled to a mandrel of a stroker tool.

3. The downhole catch assembly of claim 1, wherein the catch stem rotates with rotor rotation from a power section of a bottom hole assembly.

4. The downhole catch assembly of claim 1, wherein the installation bore is angled between 4 degrees and 15 degrees relative to the longitudinal central axis.

5. The downhole catch assembly of claim 1, wherein the landing ledge is located inside a pin of the catcher sub with the pin configured for coupling to a box of a tubular outer housing surrounding part of the catch stem extending from the catcher sub.

6. The downhole catch assembly of claim 1, wherein the landing ledge is located above a pin of the catcher sub with the pin configured for coupling to a box of a tubular outer housing.

7. The downhole catch assembly of claim 1, wherein the catch stem is coupled to move with rotor rotation from a power section of a bottom hole assembly and an enlarged internal bore of the catcher sub above the upper axial bore face accommodates the radial protrusion of the catch stem throughout eccentric motion of the rotor rotation.

8. The downhole catch assembly of claim 1, wherein central and annular flow paths extend through the downhole catch assembly in a normal operating position, and the annular flow path is blocked in the landed position.

9. The downhole catch assembly of claim 1, wherein the upper and lower axial bore faces are partial cylinders on opposite sides of the catcher sub dimensioned for tight concentric clearance fit with the radial protrusion in the landed position.

10. The downhole catch assembly of claim 1, wherein the installation bore is angled at least 4 degrees relative to the longitudinal central axis and has an inside diameter within the catcher sub at least as large as an outside diameter of the radial protrusion on the catch stem.

11. A method of using a downhole catch assembly, comprising:

providing a catcher sub having a longitudinal central axis and a landing ledge extending radially inward inside the catcher sub;

providing a catch stem having a radial protrusion forming a landing shoulder for engagement with the landing ledge within the catcher sub;

aligning the catch stem with an installation bore angled relative to the longitudinal central axis and entering a bottom terminus of the catcher sub offset relative to radial center of the catcher sub;

inserting the radial protrusion of the catch stem through the installation bore of the catcher sub and above the landing ledge without engagement of the radial protrusion with the landing ledge while the catch stem is aligned with the installation bore of the catcher sub;

aligning the catcher sub with a tubular outer housing surrounding the catch stem once the radial protrusion of the catch stem is inserted above the landing ledge, wherein the catch stem is then angled such that the landing shoulder and the landing ledge are aligned for engagement with each other; and coupling the catcher sub and the tubular outer housing together while aligned with each other.

12. The method of claim 11, further comprising running the catcher sub within a drill string into a wellbore with the catch stem coupled to a mandrel of a stroker tool.

13. The method of claim 11, further comprising rotating the catch stem with rotor rotation from a power section of a bottom hole assembly.

14. The method of claim 11, wherein the installation bore is angled between 4 degrees and 15 degrees relative to the longitudinal central axis.

15. The method of claim 11, wherein the landing ledge is located inside a pin of the catcher sub with the coupling mating the pin to a box of the tubular outer housing.

16. The method of claim 11, wherein the landing ledge is located above a pin of the catcher sub with the coupling mating the pin to a box of the tubular outer housing.

17. The method of claim 11, further comprising moving the catch stem with rotor rotation from a power section of a bottom hole assembly and accommodating the radial protrusion of the catch stem throughout eccentric motion of the rotor rotation within an enlarged internal bore of the catcher sub.

18. The method of claim 11, further comprising passing fluid through central and annular flow paths extending through the downhole catch assembly and detecting an increase in pressure when the annular flow path is blocked by movement of the catch stem to a landed position due to a downhole separation.

19. The method of claim 11, wherein the catcher sub includes upper and lower axial bore faces aligned with the longitudinal central axis and formed inside of the catcher sub above the landing ledge to facilitate in keeping the catch stem engaged with the landing ledge after movement of the catch stem to a landed position due to a downhole separation.

20. The method of claim 11, wherein the installation bore is angled at least 4 degrees relative to the longitudinal central axis and has an inside diameter within the catcher sub at least as large as an outside diameter of the radial protrusion on the catch stem.

* * * * *